United States Patent [19]

Dries et al.

[11] Patent Number: 4,662,955

[45] Date of Patent: May 5, 1987

[54] METHOD OF THERMAL STRAIN HYSTERESIS REDUCTION IN METAL MATRIX COMPOSITES

[75] Inventors: Gregory A. Dries, Newport News; Stephen S. Tompkins, Williamsburg, both of Va.

[73] Assignee: The United States of America as represented by the Administrator of the National Aeronautics and Space Administration, Washington, D.C.

[21] Appl. No.: 785,644

[22] Filed: Oct. 9, 1985

[51] Int. Cl.[4] ..... C21D 1/62

[52] U.S. Cl. ..... 148/125; 148/127; 148/159

[58] Field of Search ..... 148/125, 127, 159, 11.5 Q; 428/614

[56] References Cited

U.S. PATENT DOCUMENTS

| | | | |
|---|---|---|---|
| 2,949,392 | 8/1960 | Willey | 148/125 |
| 3,314,831 | 4/1967 | Hoenie et al. | 148/125 |
| 3,536,540 | 10/1970 | Rauch | 148/125 |
| 3,568,491 | 3/1971 | Brunner et al. | 72/364 |
| 3,871,834 | 3/1975 | Kuniya et al. | 428/614 |
| 3,891,477 | 6/1975 | Lance et al. | 148/125 |
| 4,411,380 | 10/1983 | McWithey et al. | 428/593 |
| 4,452,865 | 6/1984 | Yamatsuta et al. | 428/614 |
| 4,469,757 | 9/1984 | Ghosh et al. | 428/614 |

FOREIGN PATENT DOCUMENTS

| | | | |
|---|---|---|---|
| 0898069 | 6/1962 | United Kingdom | 148/125 |

OTHER PUBLICATIONS

Metals Handbook, vol. 4, ninth edition, p. 680, 11/81.

*Primary Examiner*—Melvyn J. Andrews
*Assistant Examiner*—S. Kastler
*Attorney, Agent, or Firm*—George F. Helfrich; John R. Manning

[57] ABSTRACT

A method is disclosed for treating graphite reinforced metal matrix composites so as to eliminate thermal strain hysteresis and impart dimensional stability through a large thermal cycle. The method is applied to the composite post fabrication and is effective on metal matrix materials using graphite fibers manufactured by both the hot roll bonding and diffusion bonding techniques.

The method consists of first heat treating the material in a solution anneal oven followed by a water quench and then subjecting the material to a cryogenic treatment in a cryogenic oven. This heat treatment and cryogenic stress reflief is effective in imparting a dimensional stability and reduced thermal strain hysteresis in the material over a −250° F. to +250° F. thermal cycle.

4 Claims, 10 Drawing Figures

METHOD OF THERMAL STRAIN HYSTERESIS REDUCTION IN METAL MATRIX COMPOSITES

ORIGIN OF THE INVENTION

The invention described herein was made in the performance of work under a NASA Contract and is subject to the provisions of Section 305 of the National Aeronautics and Space Act of 1958, Public Law 85-568 (72 Stat. 435; 42 USC 2457).

BACKGROUND OF THE INVENTION

The use of continuous fiber reinforced metal matrix composite (MMC) materials in structural applications has increased over the last few years as the aerospace industry took advantage of the superior strength to weight ratio of the new materials. New applications found the fiber reinforced composites panels, such as those with 6061 aluminum or AZ91C magnesium as the metallic matrix, to exhibit large hysteresis and residual dimensional changes during thermal cycling. These drawbacks become critical with applications requiring tight dimensional control and are especially unacceptable on precision spacecraft.

Graphite reinforced MMC materials could represent the next generation of high stiffness, low thermal expansion materials for structural applications in dimensionally stable spacecraft. These materials offer many advantages over the resin-matrix composites, viz., higher electrical and thermal conductivity, better radiation resistance and no outgassing. Currently, the 6061 aluminum alloy is one of the primary metals considered as the matrix for graphite reinforced MMC panels. This material has the very desirable combination of high stiffness and low coefficient of thermal expansion (CTE). In addition, the thermal expansion properties and stiffness may be tailored to a particular application by varying the reinforcement fiber type, number of plies, and the ply orientation. Considering the myriad of advantages, it is particularly important to solve the associatied problems.

For spacecraft applications in Earth orbit, the expected maximum temperature range over which the composite must be dimensionally stable is about 250° F. to −250° F. depending upon the thermal control coating and/or shields used. Initial testing of graphite/aluminum (Gr/Al) MMC materials over this temperature range has revealed significant strain hysteresis and residual dimension changes from the thermal cycle. This behavior is attributed to a high residual stress from fabrication and low matrix elastic limit or strength, which combined with temperature changes, result in plastic deformation within the matrix.

Various methods have been employed to reduce thermal strain hysteresis in metal matrix composite panels with less than satisfying results. One method consisted solely of a standard T6 conditioning heat treatment. This method was successful in eliminating the hysteresis in 6061 aluminum reinforced with P50 graphite fibers but was not effective when the 6061 aluminum was reinforced with P100 graphite fibers. (The numeral designates the elastic modulus in millions of pounds per square inch; P50 has a 50 million pound per square inch elastic modulus.) Success with the P50 graphite reinforced material was probably due to the lower average coefficient of thermal expansion of P50 graphite ($0.34\times10^{-6}$/°F.) than P100 graphite ($0.75\times10^{-6}$/°F.), which results in significantly lower thermal strains in the matrix for a given temperature change. The associated lower thermal stresses could be more easily accommodated by the matrix without plastic defomation and without any change in the residual stress state. However, stiffness requirements of the spacecraft structures dictate that P100 Gr/6061 Al composite materials be used.

It is important to find a method that can provide dimensional stability and reduce thermal strain hysteresis in metal matrix composite fabricated both by the hot roll bonding and the diffusion bonding methods of manufacture as both fabrication methods are used for material presently Accordingly, it is an object of the present invention to provide a method of eliminating thermal strain hysteresis in reinforced metal matrix composite materials.

It is another object of the present invention to provide a method of increasing the dimensional stability of fiber reinforced metal matrix composite materials.

It is yet another object of the present invention to provide a method of treatment to reduce thermal strain hysteresis in reinforced metal matrix composite materials that is employed post fabrication.

It is a further object of the present invention to provide a method of treatment of reinforced metal matrix composite materials that increases dimensional stability and can be utilized post fabrication.

It is another object of the present invention to provide a method of post fabrication treatment to reduce thermal strain hysteresis and dimensional instability in graphite reinforced metal matrix composite material that uses P100 graphite fibers.

It is yet another object of the present invention to provide a method of post fabrication treatment to reduce thermal strain hysteresis and provide dimensional stability to metal matrix composite materials fabricated both by hot roll bonding and by diffusion bonding methods.

STATEMENT OF THE INVENTION

According to the present invention, the foregoing and additional objects are attained by heat treating the composite material, using standard methods specified for the matrix alloy, followed by exposing the composite to cryogenic temperatures (cryogenic stress relief). The optimum cryogenic stress relief temperature, as well as the necessary heat treatment, depends upon the particular material system and the method of manufacturing the composite, i.e., whether the material is made by diffusion or hot roll bonding. The cryogenic stress relief step is complete when the material has come to thermal equilibrium at the cryogenic temperature.

The effect of this novel use of cryogenic stress relief and thermal heat treatment on the elastic behavior of the matrix alloy has been tested by the National Aeronautics and Space Administration. The effect of the heat treatment is to increase the elastic limit of the matrix under both tensile and compressive loading, i.e., increase the elastic rage of the matrix. Cryogenic stress relief causes a reduction in the residual strain. This increases the magnitude of thermal tensile strains which can be accommodated without plastic deformation. Since cooling of the composite material results in increased tensile loading of the matrix, lower temperatures can now be tolerated without plastic yielding, resulting in reduced thermal strain hysteresis.

BRIEF DESCRIPTION OF THE DRAWINGS

A more complete appreciation of the invention and many of the attendant advantages thereof will become more readily apparent as the same becomes better understood by reference to the following detailed description when considered in connection with the accompanying drawings wherein.

DETAILED DESCRIPTION OF THE INVENTION

The heat treatments used to strengthen the matrix were the standard T6 conditioning treatment or a T5 conditioning treatment (a low temperature post fabrication aging treatment). The standard T6 conditioning treatment is commonly used to strengthen the Al 6061 wrought alloy. The T5 conditioning treatment, although not commonly applied to 6061 wrought alloy, is used to increase the strength of some alloys after high temperature processing. In the present invention both treatments were conducted in circulating air furnaces. The furnace temperatures during treatment were continuously monitored by a chromel-alumel thermocouple and were maintained within ±5° F. of the desired temperature.

The standard T6 conditioning treatment consists of a solution anneal at 985° F. for one-half hour followed by a water quench at room temperature. Specimen aging was initiated within one day after the solution anneal and in most cases within one hour after annealing. A solution anneal is simply bringing the panel to a temperature where the different constituents in the panel go into solid solution. All T6 conditioned specimens were refrigerated at about 32° F. during the time between the water quench and the artificial aging to prevent natural aging. This refrigeration step may be omitted if the artificially aging is started immediately or soon after the quenching. Artificial aging was done at a temperature of 340° F. for 20 hours. The T5 aging treatment consisted of a 23 or 24 hour exposure at 300° F., followed by static air cooling to room temperature.

Several different cryogenic stress relief temperatures are used. In all cases the temperature of the stress relief environment was continuously monitored by a chromel-alumel thermocouple attached to a reference specimen. For temperatures warmer than −175° F., a cold bath consisting of ethyl alcohol is cooled to the desired temperature using $LN_2$. Cryogenic stress relief involved submerging the specimen into the bath, allowing several minutes to ensure the specimen temperature has stabilized, and removing the specimen to warm in ambient air.

For temperatures colder than −175° F., a cold chamber cooled by $LN_2$ capable of a temperature of −285° F. was used. Two high-flow fans located at the rear of the chamber maintains a uniform temperature distribution. Stress relief was accomplished by inserting the specimen into the pre-cooled chamber, allowing several minutes for the specimen to reach the desired temperature, and then removing the specimen to warm to room temperature in ambient air.

Figure 1:
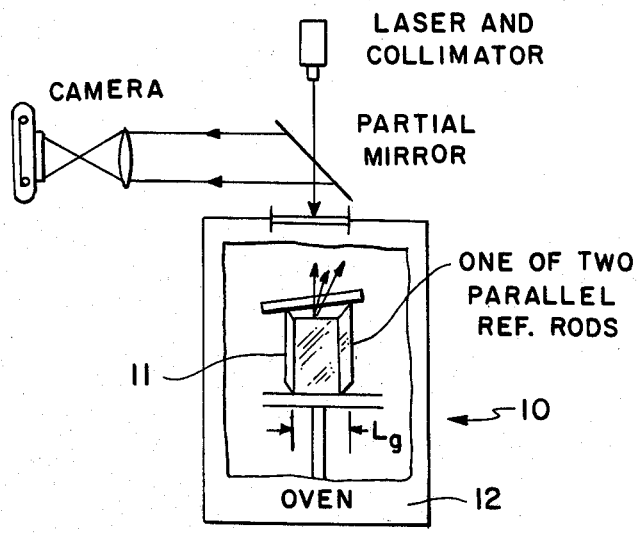
FIG. 1 is a schematic diagram of a dilatormeter system and specimen employed in the process of the present invention.

A Fizeau type laser interferometric dilatometer was used to measure the length changes of each specimen relative to changes in a reference material and may be purchased commercially. The NBS Standard Reference Material, 739 fused-silica, was used in preliminary testing. The dilatometer system used is schematically shown in FIG. 1 and designated generally by reference numeral 10. Specimens 11, about 3.0 inches by 1.0 inch, were machined from sheet supplied by each manufacturer such that the fibers were oriented longitudinally. Each end of the specimen was rounded and beveled to provide single point contact in the interferometer. Final adjustment in the length to maintain practical fringe densities of between 20 to 40 fringes/inch over the temperature range was made by very light polishing with 600 grit paper. The surfaces of the interferometer in contact with the reference rods and specimen were cleaned with alcohol. The cleaned interferometer with reference rods and specimen was placed in chamber 12 for testing.

During testing, the test chamber set point temperature was changed in 40° F. steps every 45 minutes. The rate of specimen temperature change never exceeded about 3° F. per minute. At the end of each temperature step, the fringe pattern was recorded on 35-mm film and the specimen temperature was recorded. At the conclusion of each test, the 35-mm film was developed and negatives were placed in a microfiche reader and the fringes were visually counted over a defined gage length. The fringe density (fringes/length) was determined as a function of temperature.

The specimen strain relative to the reference material is given by the equation:

$$\epsilon_r = \Delta N \lambda L_g / (2L_s)$$

where $\Delta N$ is the change in fringe density with temperature changes, $\lambda$ is the laser wavelength, $L_g$ is the length between specimen and reference rods, and $L_s$ is the specimen length. Since the thermal strain of the reference material, $\epsilon_R$, is known, the total strain of the specimen is given by:

$$\epsilon_T = \epsilon_r + \epsilon_R$$

The strain resolution using this technique is about one microstrain.

Microhardness measurements in the surface foils of metallographically prepared laminate cross-sections were used to evaluate the affects of heat treatments. The test procedure used was the ASTM E-384-73, the Standard Method of Test for Microhardness of Materials. Most microhardness measurements were made within the surface foils. Only limited hardness measurements were made in the matrix because of interference with the graphite fibers. Microhardness values are averages of at least ten separate measurements, each at different random locations on the specimen.

Figure 2:
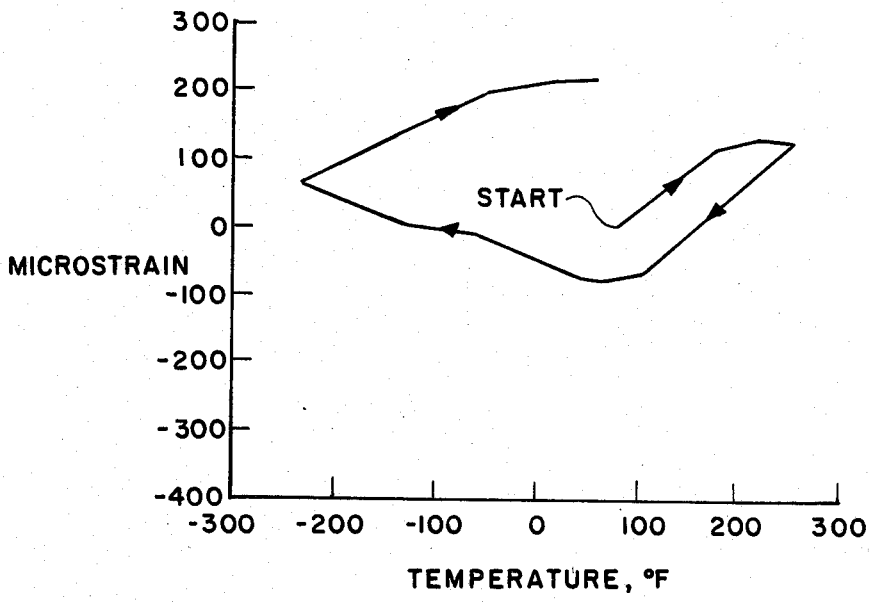
FIG. 2 is a graph showing the thermal expansion behavior of as fabricated single ply P100 Gr/6061 Al.

A typical thermal expansion curve for an as received P100/6061 metal matrix composite is shown in FIG. 2. The shape of this curve might be explained, qualitatively, by the following series of events. During initial heat up from room temperature, the matrix expands while the fibers contract. At higher temperatures, about 170° F., the matrix plastically deforms under compression and the laminate expansion becomes dominated by the fiber and the CTE decreases. The matrix continues to deform to maximum temperature, about 250° F. On cool down from the maximum temperature the fiber expands while the matrix contracts leading to a reversal of thermal strains until the matrix plastically deforms agains under tension below about 100° F. As the matrix deforms, the laminate again follows the fiber response. On heat up from the coldest temperature, about −250° F., the matrix again expands while the fiber contracts and the laminate CTE is similar to the CTE during the initial heat up from room temperature.

Elimination of the loop and the residual offset will require an increased matrix elastic range and/or a reduced residual stress within the composite. Heat treatment is a proven method to increase the elastic limit and yield strength, and cryogenic exposure is a proven method to alter the residual stress in metal matrix composites.

Figure 3:
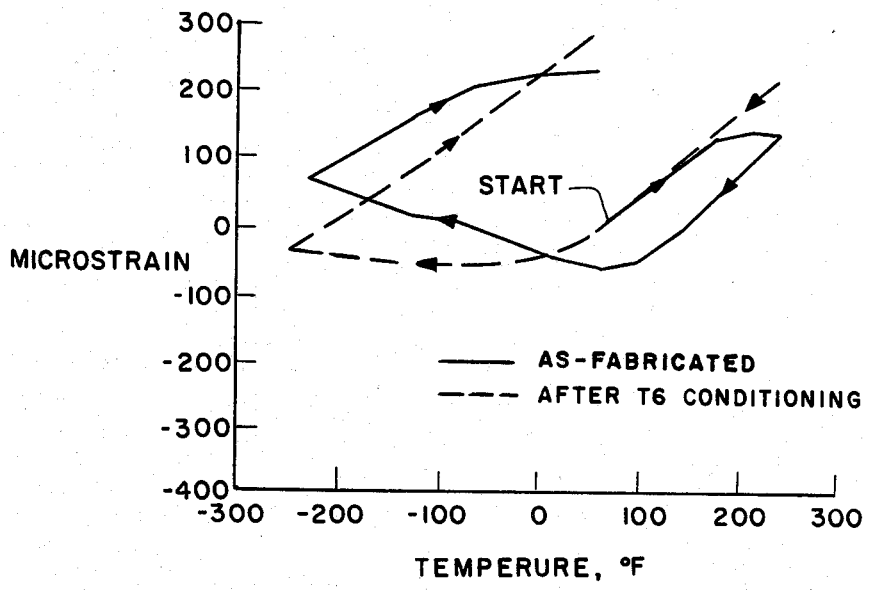
FIG. 3 is a graph depicting thermal expansion behavior of hot roll bonded P100/6061 Al as fabricated and after T6 conditioning.

The standard T6 heat treatment is used commercially to increase the elastic limit, the yield and ultimate strengths of 6061 Al panels. The effects of using the T6 conditioning treatment on the metal matrix composite fabricated by hot roll bonding are shown in FIG. 3. A T6 conditioning treatment eliminated the residual dimensional changes during the initial high temperature part of the thermal cycle but a large, residual strain was present after cycling from RT to −250° F. to RT. This behavior is inconsistent with previous tests which showed elimination of the thermal strain hysteresis over the entire temperature range by T6 conditioning a hot roll bonded 6061 Al reinforced with P50 graphite fibers. The difference between the two tests is due to the different graphite fibers used. The Gr/Al laminate used in the first test was reinforced with P50 graphite fibers with an average coefficient expansion ($\alpha$) of about $-1.3\times10^{-6}$/°F., which is less than half that of the P100 fibers ($\alpha=-2.9\times10^{-6}$/°F.) used. Therefore, for a given increase in the elastic range, the thermal strains associated with P50 fibers can be more easily accommodated than with P100 fibers.

Figure 4:
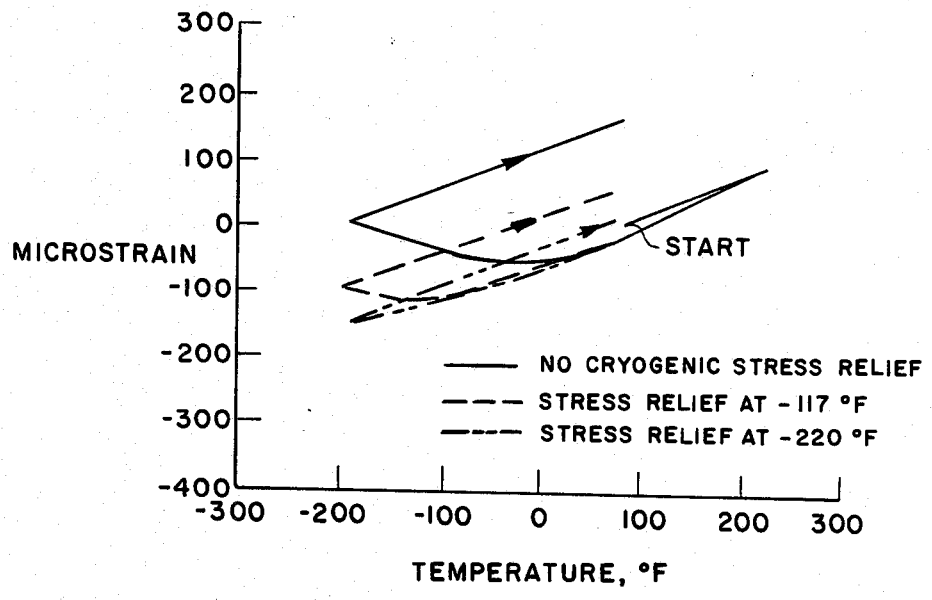
FIG. 4 is a graph illustrating thermal expansion behavior of heat treated P100 Gr/6061 Al after cryogenic stress relief at different temperatures.

Cryogenic stress relief provides a means to reduce the as fabricated residual stresses within composite laminates by plastic deformation of the matrix. This stress relief can also provide a slight additional increase in the matrix elastic range due to work hardening. The effect of reduced residual stresses on the thermal expansion behavior of heat treated P100 Gr/6061 Al composition is shown in FIG. 4. The data show a decrease in the residual strain, i.e., the dimensional set resulting from one thermal cycle, and a decrease in the magnitude of the thermal strain hysteresis, with lower stress relief temperatures.

Figure 5:
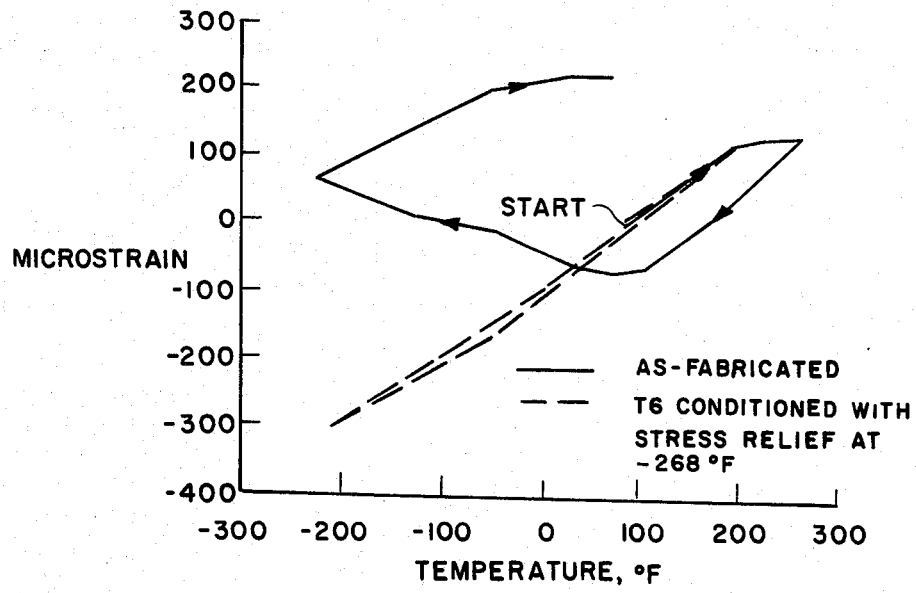
FIG. 5 is a graph depicting thermal expansion behavior of roll bonded single ply P100 Gr/6061 Al before and after processing to minimize hysteresis.

Test results indicate that thermal strain hysteresis is minimized in P100 Gr/6061 Al composites by stress relief at temperatures between −265° F. and −270° F. FIG. 5 shows the thermal expansion behavior of hot roll bonded metal matrix composite before and after processing to minimize the thermal strain hysteresis. This processing consists of T6 conditioning to maximize the elastic range and cryogenic stress relief at a temperature of −268° F. The data show that the post fabrication processing methodology, i.e., heat treatment followed by cryogenic stress relief completely removes residual strain after one cycle and considerably reduces hysteresis.

Figure 6:
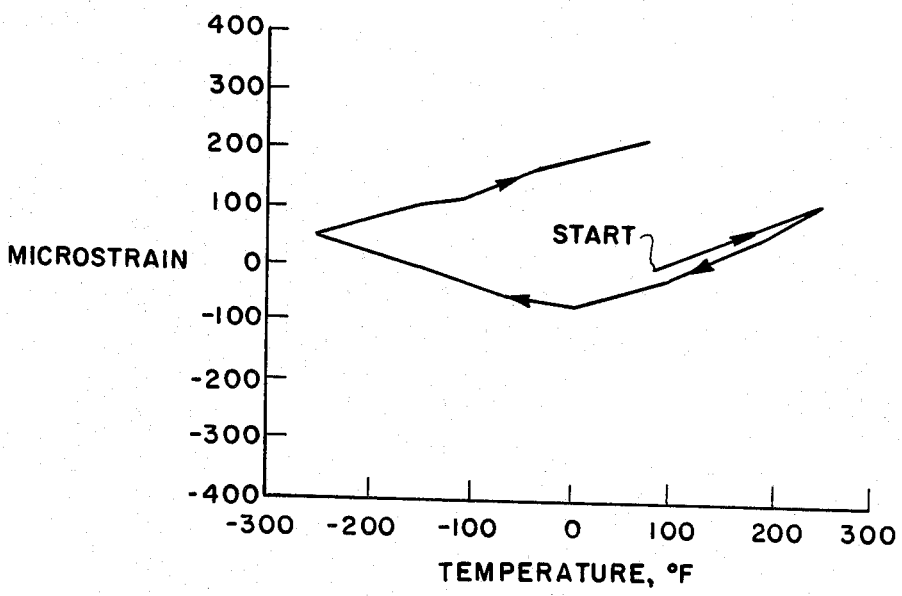
FIG. 6 is a graph showing thermal expansion behavior of diffusion bonded P100 Gr/6061 Al after T6 conditioning.
Figure 7:
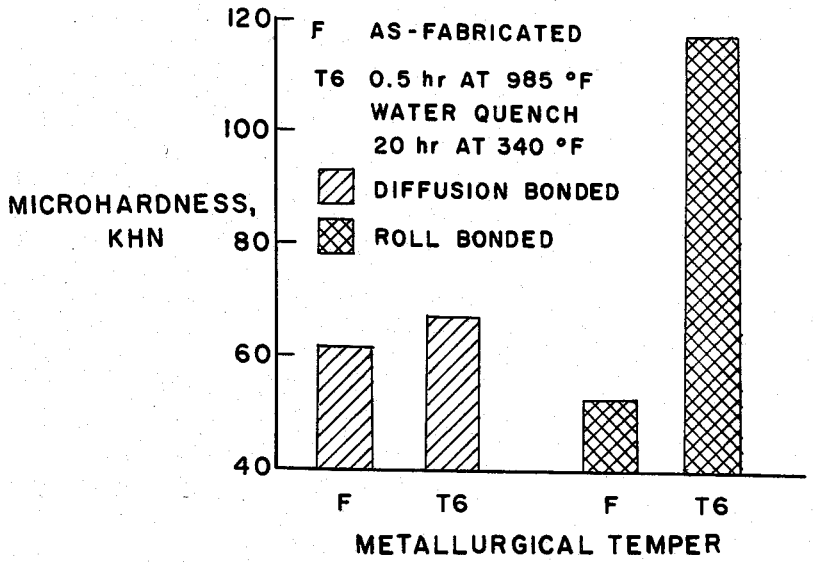
FIG. 7 is a bar graph depicting the microhardness of diffusion bonded and roll bonded P100 Gr/6061 Al as fabricated and after T6 conditioning.

Attempts to achieve similar reductions in thermal strain hysteresis in diffusion bonded panels were initially less successful due to the poor response of the material to T6 conditioning (FIG. 6). This heat treatment did not eliminate residual dimensional changes after the high temperature part of the thermal cycle, as it did for the hot roll bonded material, which indicates only a minor increase in the matrix elasti range. This small increase in elastic limit was corroborated by microhardness measurements taken in the surface foils of metallographically prepared cross-sections. FIG. 7 shows microhardness measurements for diffusion bonded and hot roll bonded metal matrix composite in the as fabricated condition and after T6 conditioning. The high hardness values of the hot roll bonded material compared to the diffusion bonded material after T6 conditioning indicates a high strength is induced in the hot roll bonded material.

Figure 8:
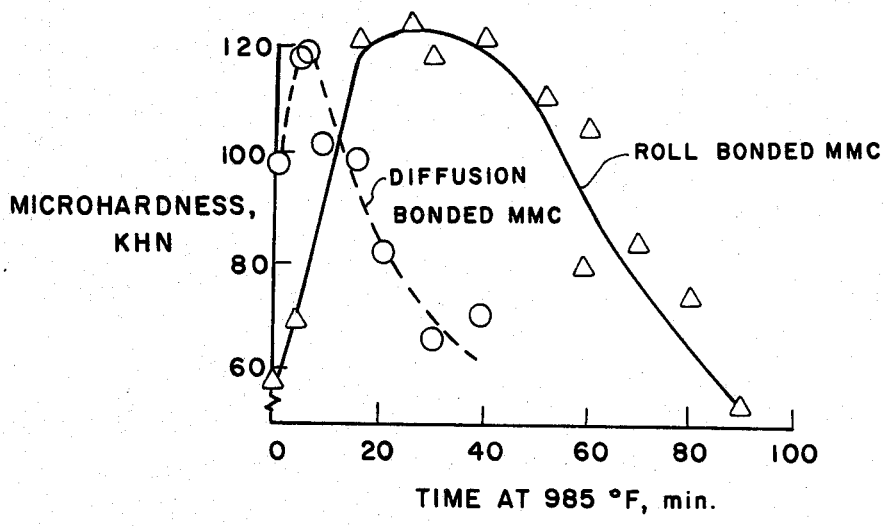
FIG. 8 illustrates the response of diffusion bonded and hot roll bonded P100 Gr/6061 Al to T6 conditioning as a function of solution annealing time.

FIG. 8 shows the hardness of each material, after a 20-hour age at 340° F., as a function of solution annealing time. The decrease in hardness attained by each material with times longer than the optimum solutioning annealing time is very significant. This accounts for the low hardness and perhaps low elastic range of the as received diffusion bonded material after the T6 conditioning which involved the typical 20- to 30-minute solution anneal. Since the enhancement of mechanical properties of 6061 Al by T6 conditioning result from the precipitation of magnesium silicide ($Mg_2Si$), changes in alloy chemistry during the solution anneal may account for the decreased aging response. Magnesium depletion was investigated by Atomic Absorption (AA) chemical analyses. These results show that each of the three specimens solution annealed for one hour at 980° F. had a lower magnesium concentration than in the as fabricated condition. Although this does not conclusively prove that magnesium depletion is responsible for the lower hardness after prolonged solution annealing (FIG. 8), the results are consistent with the microhardness measurements.

Figure 9:
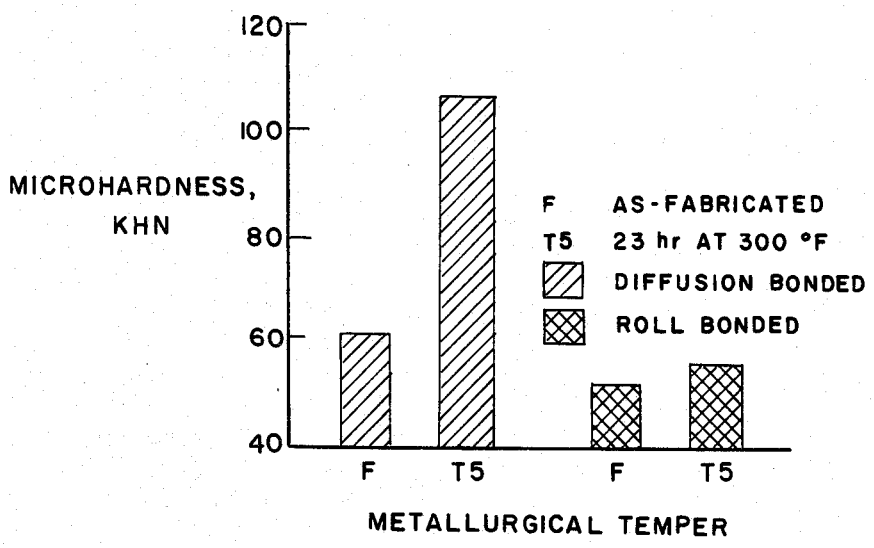
FIG. 9 is a bar graph showing the microhardness of diffusion bonded and hot roll bonded P100 Gr/6061 Al as fabricated and after T5 conditioning.

The difference in the optimum solution annealing times for each composite (FIG. 8) may indicate differences in the as fabricated metallurgical conditions. The time needed to reach peak hardness was approximately five minutes for diffusion bonded material and 25 to 30 minutes for hot roll bonded material, which indicates these composites, in the as fabricated condition, are underaged and overaged, respectively. This is verified by the responses of each material to T5 conditioning as shown in FIG. 9. The T5 treatment parameters for maximum hardness are experimentally determined for the diffusion bonded material to be 23 hours at 300° F.

Collectively, these data show that the elastic range of the matrix in diffusion bonded material may be increased by either T6 conditioning (with a nonstandard, short five minute solution anneal) or by T5 conditioning. Since solution annealing often produced severe warpage, especially in single ply material samples, T5 conditioning is considered advantageous over T6 conditioning.

Figure 10:
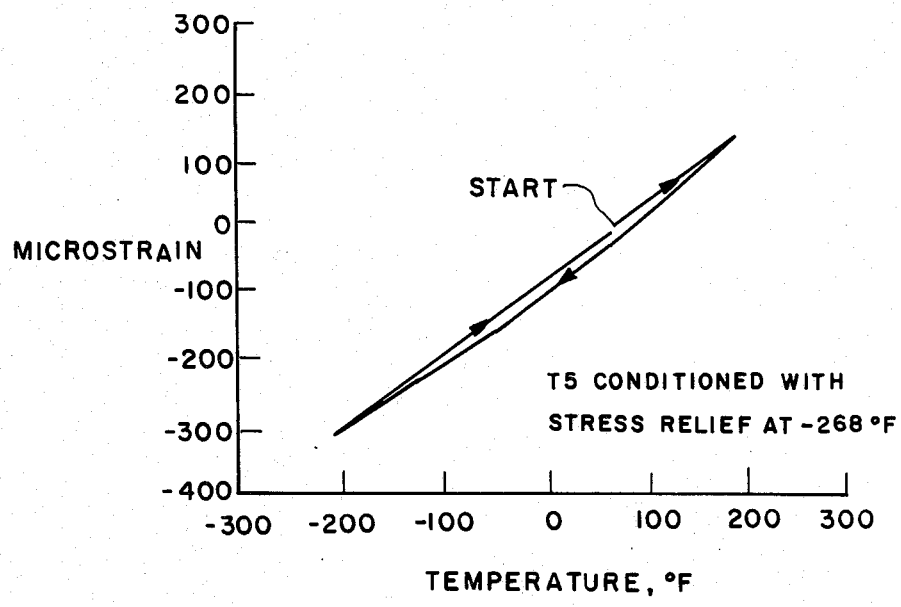
FIG. 10 is a graph showing thermal expansion behavior of diffusion bonded P100 Gr/6061 Al after processing to minimize hysteresis.

The thermal expansion behavior of diffusion bonded single ply material after T5 conditioning and cryogenic stress relief at −268° F. is shown in FIG. 10. This T5 treatment on diffusion bonded material significantly reduces the thermal cycle hysteresis.

These methods of post fabrication treatment and other variations and modifications of the invention will be readily apparent to those skilled in the art in the light of the above teachings. Thus, within the scope of the appended claims, the invention may be practiced other than as specifically described herein.

What is claimed as new and desired to be secured by Letters Patent of the United States is:

1. A method of treating graphite fiber reinforced aluminum alloy matrix composite panels to eliminate thermal strain hysteresis and increase dimensional stability thereof comprising the steps of:

(a) providing a graphite fiber reinforced aluminum alloy matrix composite panel;

(b) heat treating the composite panel sufficient to solution anneal the composite, to develop maximum strength at a temperature in the range of 920° F. to 985° F. for approximately one-half hour;

(c) removing the panel from the annealing oven and water quenching to room temperature;

(d) artifically aging the water-quenched panel by heating to a temperature of 300° F. to 340° F. and maintaining at this temperature for eight to twenty-four hours;

(e) statically cooling the heated panel to room temperature;

(f) cryogenically cooling the artifically aged panel to a temperature of −268° F.±5° F.; and (g) permitting the cryogenically cooled panel to warm to room temperature in ambient air to recover a graphite fiber reinforced aluminum alloymatrix composite panel having improved thermal cycle strain hysteresis physical property characteristics.

2. The method of claim 1 wherein the graphite fiber is selected from the group of graphite fibers consisting of P50 and P100 graphite fibers and the aluminum alloy matrix is 6061 Al.

3. A method of metal matrix composite material treatment of claim 1 where said material is a metal matrix composite formed of 6061 aluminum alloy and graphite fibers bonded by hot roll bonding and the solution anneal treatment is applied for thirty minutes at 985° F.; the artificial aging is applied for twenty hours at 340° F.; and the cryogenic stress relief is at a temperature of −268° F.±5° F.

4. A method of metal matrix composite material treatment of claim 1 where the metal matrix composite is formed of 6061 aluminum and graphite fibers, bonded by diffusion and the solution anneal treatment is applied for five minutes at 985° F.; the artificial aging is applied for twenty-three hours at 300° F.; and, the cryogenic stress relief is at a temperature of −268° F.±5° F.

* * * * *